US007337851B2

(12) United States Patent
Hall et al.

(10) Patent No.: US 7,337,851 B2
(45) Date of Patent: Mar. 4, 2008

(54) ROTATING STUFFING BOX WITH SPLIT STANDPIPE

(75) Inventors: Craig Melvin Hall, Lashburn Sask. (CA); Derek Tebay, Lloydminster (CA)

(73) Assignee: Weatherford/Lamb, Inc., Houston, TX (US)

( * ) Notice: Subject to any disclaimer, the term of this patent is extended or adjusted under 35 U.S.C. 154(b) by 195 days.

(21) Appl. No.: 10/933,819

(22) Filed: Sep. 3, 2004

(65) Prior Publication Data

US 2006/0048947 A1 Mar. 9, 2006

(51) Int. Cl.
*E21B 33/00* (2006.01)

(52) U.S. Cl. ..... 166/377; 166/84.1; 166/68.5

(58) Field of Classification Search ..... 166/377, 166/79.1, 84.1, 84.3, 84.4
See application file for complete search history.

(56) References Cited

U.S. PATENT DOCUMENTS

| | | | | |
|---|---|---|---|---|
| 5,327,961 | A | 7/1994 | Mills | |
| 5,711,533 | A | 1/1998 | Angelo et al. | |
| 5,791,411 | A * | 8/1998 | Ricalton et al. | 166/84.1 |
| 5,803,169 | A | 9/1998 | Bassinger et al. | |
| 6,557,643 | B1 | 5/2003 | Hall et al. | |
| 2001/0050168 | A1 | 12/2001 | Hult | |
| 2006/0032635 | A1 * | 2/2006 | Rivard | 166/287 |

FOREIGN PATENT DOCUMENTS

| | | |
|---|---|---|
| CA | 2311036 | 9/2001 |
| CA | 2 397 360 | 2/2004 |
| CA | 2 436 924 | 2/2004 |
| WO | WO 2004/092538 | 10/2004 |

OTHER PUBLICATIONS

U.K. Search Report, Patent Application No. GB0518029.4, dated Dec. 1, 2005.
CA Office Action, Application No. 2,517,801, Dated Feb. 19, 2007.

* cited by examiner

*Primary Examiner*—David Bagnell
*Assistant Examiner*—Robert Fuller
(74) *Attorney, Agent, or Firm*—Patterson & Sheridan, LLP

(57) ABSTRACT

A system comprising a top mounted rotating stuffing box is provided for use with downhole pump (e.g., Progressing Cavity Pump) applications. The system also includes a split standpipe configuration that allows the stuffing box to be quickly installed or removed as needed. The split standpipe feature combined with the top-mounted aspect of the stuffing box allow for the corresponding drive units to stay intact while the stuffing box is being installed or removed.

21 Claims, 6 Drawing Sheets

ROTATING STUFFING BOX WITH SPLIT STANDPIPE

BACKGROUND OF THE INVENTION

1. Field of the Invention

The present invention generally relates to wellhead components for supporting the use of downhole pumps. More particularly, the present invention relates to a top mounted rotating stuffing box configured for sealing production fluid from the atmosphere.

2. Description of the Related Art

Oil and gas in newly discovered reservoirs usually flow to the surface by natural lift. The natural formation pressure of a reservoir provides the energy or driving force to move reservoir fluids horizontally into a wellbore, through production tubing, and through surface processing equipment. During the life of any producing well, however, the natural reservoir pressure decreases as reservoir fluids are removed from the formation. As the natural downhole pressure drops to the sum of the hydrostatic head in the wellbore and the facility pressure, the fluids cease to spontaneously flow to the surface. Therefore, artificial lift methods such as sucker-rod pumping, downhole pumping, and gas injection lift techniques, for example, are employed to lift the fluids to the surface.

Many wells today use a downhole pumping apparatus such as progressing cavity pump (PCP) systems to lift fluids from within the production well to the surface. As its name implies, a PCP system comprises a PCP, also referred to herein as "pump", located within the wellbore and a drive system located at the surface of the well. A drive system comprises, among other components, a motor (typically a hydraulic motor) for providing torque and rotation to a drive string, and a drive unit for transmitting the torque downhole. A drive string disposed within the production tubing connects the pump and hydraulic motor. The pump comprises a rotor disposed within a stator located within the production tubing. The well is produced by utilizing the hydraulic motor to rotate the drive string, which, in turn, drives the rotor of the pump. The result is a non-pulsating positive displacement flow of fluids towards the surface of the well.

A major problem associated with downhole PCP implementations is sealing the pressurized production fluid and preventing it from escaping into the atmosphere from surface equipment. Often, stuffing boxes are used to help seal to the production fluid. Accordingly, numerous stuffing boxes for use with PCP implementations are available in the marketplace. Typically, the stuffing boxes are of the bottom mount variety. As the term "bottom mount" implies, the stuffing boxes are placed below the hydraulic motor and other components of the drive system. In many cases, the stuffing box is located beneath the drive system and directly above the wellhead.

The harsh operating environment of a PCP implementation necessitates regular servicing of stuffing boxes due to failed bearings and seals within. Servicing or replacing stuffing boxes prove to be difficult in the case of bottom mount stuffing boxes because they are difficult to gain access to. This is mainly because the drive system needs to be disconnected from the wellhead in order to remove the stuffing box.

There are some top mount stuffing boxes available in the marketplace, but they utilize rope packings as the primary seals. Those skilled in the art will understand that under rigorous conditions, rope type packings have a tendency to lose shape, or "weep", which renders these packings ineffective for containing pressurized production fluids. Further, available top mounted stuffing boxes tend to damage other components of the drive system, such as a drive unit.

Therefore, there is a need for a top mounted stuffing box that allows for quick installation or removal without requiring the removal of other components of the drive system, such as the hydraulic motor or the drive unit. There is a further need for the stuffing box to contain seals that are more reliable and wear resistant than those known in existing stuffing boxes known in the art. There is yet a further need for the stuffing box to mate with other components of the drive system in a manner that will not damage these components.

SUMMARY OF THE INVENTION

In one respect, the present invention provides a downhole pump implementation. The downhole pump implementation comprises a drive string and a drive system comprising a top mounted rotating stuffing box, wherein the top mounted rotating stuffing box rotates with the drive string. The downhole pump implementation also includes a downhole progressing cavity pump.

In another respect, the present invention provides a method of replacing a stuffing box. The method includes providing a wellhead and a drive system, wherein the drive system comprises a top mounted rotating stuffing and a drive unit. The method also includes providing a safety clamp for securing the weight of the drive string. The method also includes shutting down the well, securing the weight of the drive string by placing the safety clamp on an exposed portion of the drive string at the surface and holding the drive unit stationary. The method also includes rotating the stuffing box a quarter turn in either direction, relative to the drive unit and lifting the stuffing box upwards and removing the stuffing box from the drive system.

In yet another respect, the present invention provides an assembly for pumping fluid. The assembly includes a top mounted rotating stuffing box, an upper stand pipe and a lower standpipe. The assembly also includes a drive system comprising a drive unit, and a drive string.

BRIEF DESCRIPTION OF THE DRAWINGS

So that the manner in which the above recited features, the advantages and objects for the present invention can be more fully understood, certain embodiments of the invention are illustrated in the appended drawings.

DETAILED DESCRIPTION OF THE PREFERRED EMBODIMENT

The apparatus and methods of the present invention, in the context of downhole pump implementations, provide the sealing of production fluid from the environment using a top-mounted rotating stuffing box.

The discussion below focuses primarily on utilizing top-mounted rotating stuffing boxes together with a split standpipe configuration for use with downhole pump implementations, such as progressing cavity pumps (PCP's). The principles of the present invention also allow for the quick installation or removal of the stuffing box without the need to remove other components such as a corresponding drive unit belonging to a drive system.

Figure 1:
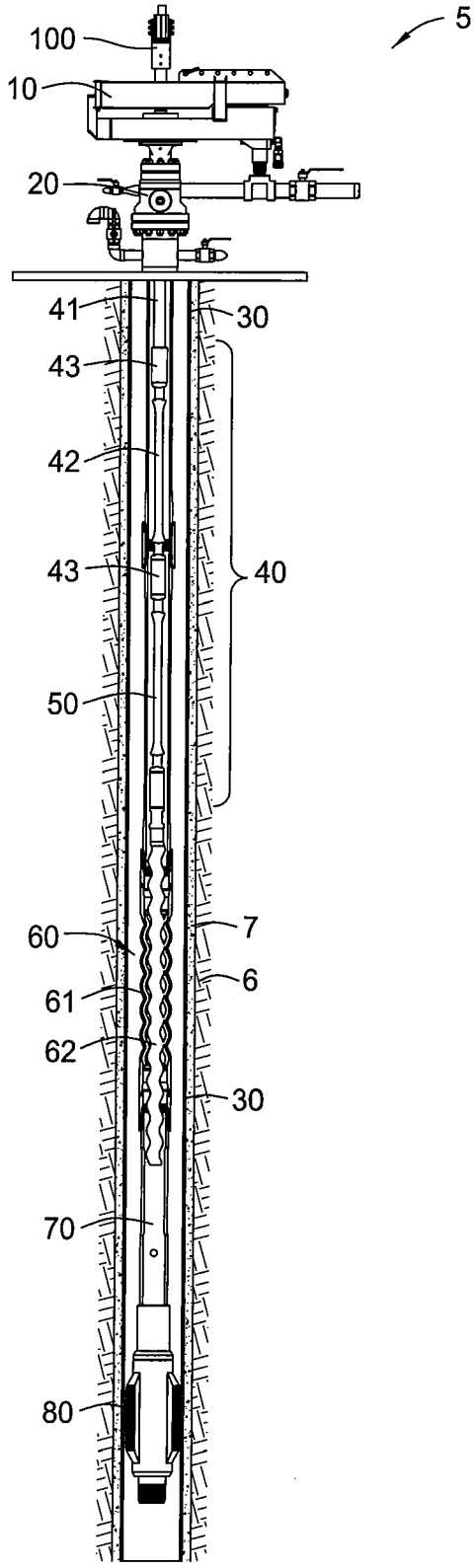
FIG. 1 is a cross-sectional view of a wellbore illustrating a rotating stuffing box, hydraulic, motor, drive unit and Progressing Cavity Pump (PCP) in accordance with one embodiment of the present invention.

FIG. 1 presents a cross-sectional view of a wellbore 5. As illustrated, the wellbore 5 has a string of casing 30 fixed in the formation 6 by cured cement 7. The wellbore 5 also includes a downhole PCP implementation in accordance with one embodiment of the present invention. Surface components of the PCP implementation include a hydraulically powered drive system 10 and composite pumping tree 20. Downhole components of the PCP implementation include a drive string 40, PCP 60 and an anchor 80.

Surface based drive systems, and more specifically hydraulic motor based drive systems, have been used with downhole PCP's for more than two decades. These systems are ideal for applications requiring precise torque control and adjustable wellhead speed. Referring back to FIG. 1, the drive system 10, which includes the hydraulic motor 11, suspends and rotates a drive string 40 that, in turn, operates a downhole PCP 60. The drive system 10 also comprises a stuffing box 100 and a drive unit 200 according to one embodiment of the present invention; these components will be described in more detail with reference to FIGS. 2, 3 and 4.

Below the drive system 10 is a composite pumping tree 20 (also referred to herein as a wellhead), which typically comprises high and low pressure rams to manage the pressure of the production fluid and to keep the fluid from escaping into the atmosphere from the interface between the wellhead and the remainder of the wellbore components below.

The wellbore 5 also comprises casing 30 that is located below the wellhead and extends downhole to the production zone. Those skilled in the art will appreciate that a wide variety of casing (e.g., different sizes, materials, etc.) is available in the marketplace. In the context of the present invention, it should be understood that the casing extends from the wellhead 20 to below the PCP 60. In other words, the drive string 40 and PCP operate within the casing 30.

The drive string 40 may comprise multiple polished rods 41 and sucker rods 42 connected to each other via threaded couplings 43. Polished rods 41 are manufactured to tight tolerances and therefore have exceptionally uniform outer diameters that are polished to facilitate a pressure seal at the interface between the polished rod and the stuffing box 100. Sucker rods 42 are similar to polished rods 41, but do not provide the polished surfaces, as they are not meant to interact with seals. Sucker rods 42 are threaded on each end and are manufactured to dimension standards and metal specifications set by the petroleum industry, typically their lengths are between 25 to 30 feet and the diameter varies from ½ to 1⅛ inches.

The Progressing Cavity Pump 60 may be located directly below the sucker rods 42. Typically, PCP's 60 comprise a single helical-shaped rotor 62 that turns inside a double helical elastomer-lined stator 61. The stator 61 is attached to the production tubing string 50 above and remains stationary during pumping. It is quite common for External Upset Ends (EUE) type tubing to be utilized as production tubing 50. As stated earlier, the rotor 62 may be attached to the drive string 40 which is suspended and rotated by the drive system at the surface. As the rotor 62 turns eccentrically in the stator 61, a series of sealed cavities form and progress from the inlet to the discharge end of the pump 60. The result is a non-pulsating positive displacement flow of production fluid with a discharge rate proportional to the size of the cavity, rotational speed of the rotor 62 and the differential pressure across the pump 60.

For one embodiment, fluid is directed to the inlet of the PCP 60 via a tagbar 70. Connected below the tagbar 70 is an anchor 80, which restricts the stator 61 and production tubing 50 from rotating. In other words, the anchor provides for relative rotation between the stator 61 and rotor 62, thereby allowing the pump to urge production fluid uphole.

Figure 2:
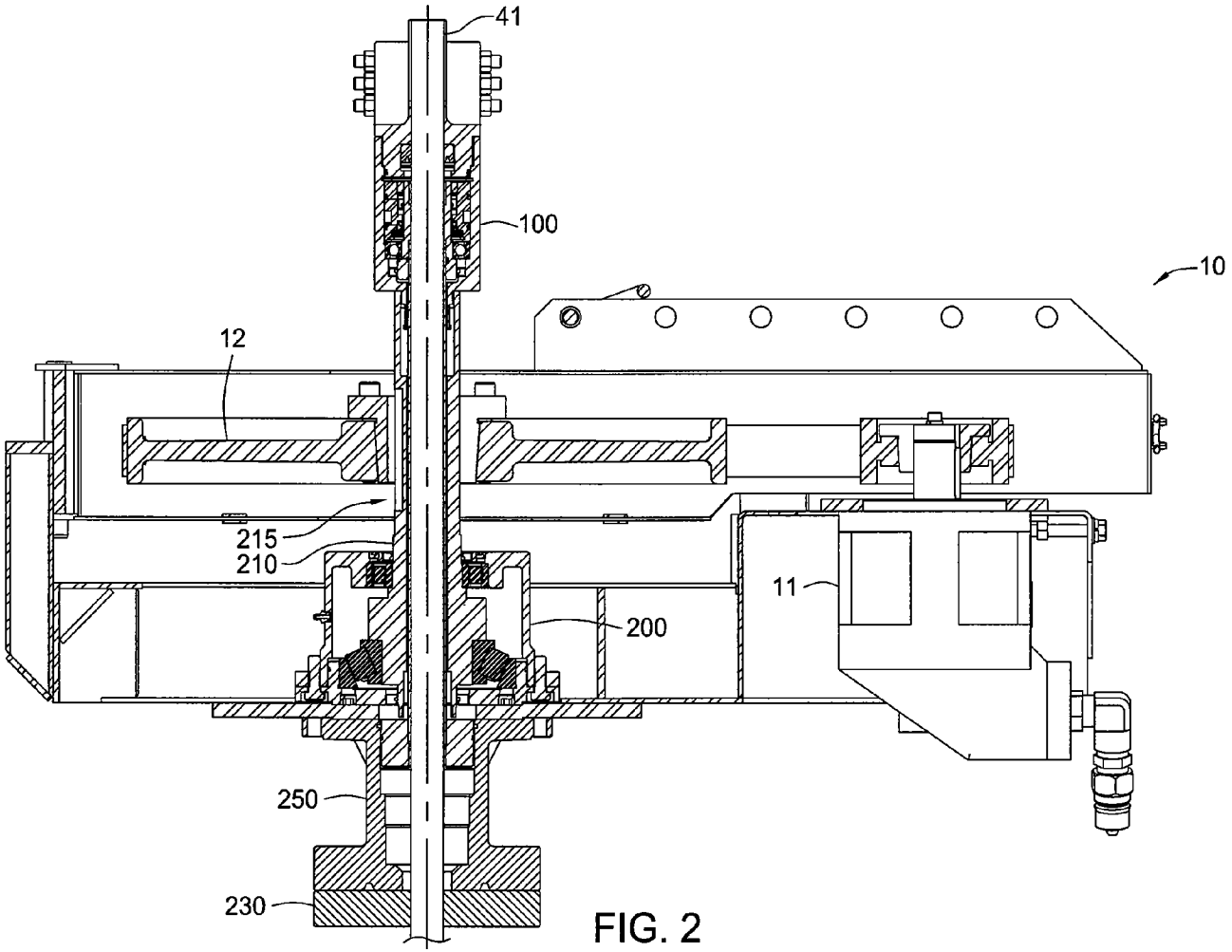
FIG. 2 is a cross-sectional view of a rotating stuffing box, drive unit and hydraulic motor according to one embodiment of the present invention.

FIG. 2 presents a cross-sectional view of a hydraulic drive system 10 comprising a hydraulic motor 11, rotating stuffing box 100, and drive unit 200 according to one embodiment of the present invention. An integral housing 250 connects the drive system 10 to the wellhead 20 below. The stuffing box 100 is installed at the top of the main shaft 210 of the drive unit 200. For one embodiment, a drive gear 12 is coupled to the main shaft 210 via the main shaft slot 215. The main shaft slot 215 allows for torque supplied by the hydraulic motor 11 to be transferred through the main shaft 210. The stuffing box 100 and the manner in which it interfaces with the top of the main shaft 210 will be described in detail with reference to FIG. 3, and the drive unit 200 will be described in more detail with reference to FIG. 4.

Figure 3:
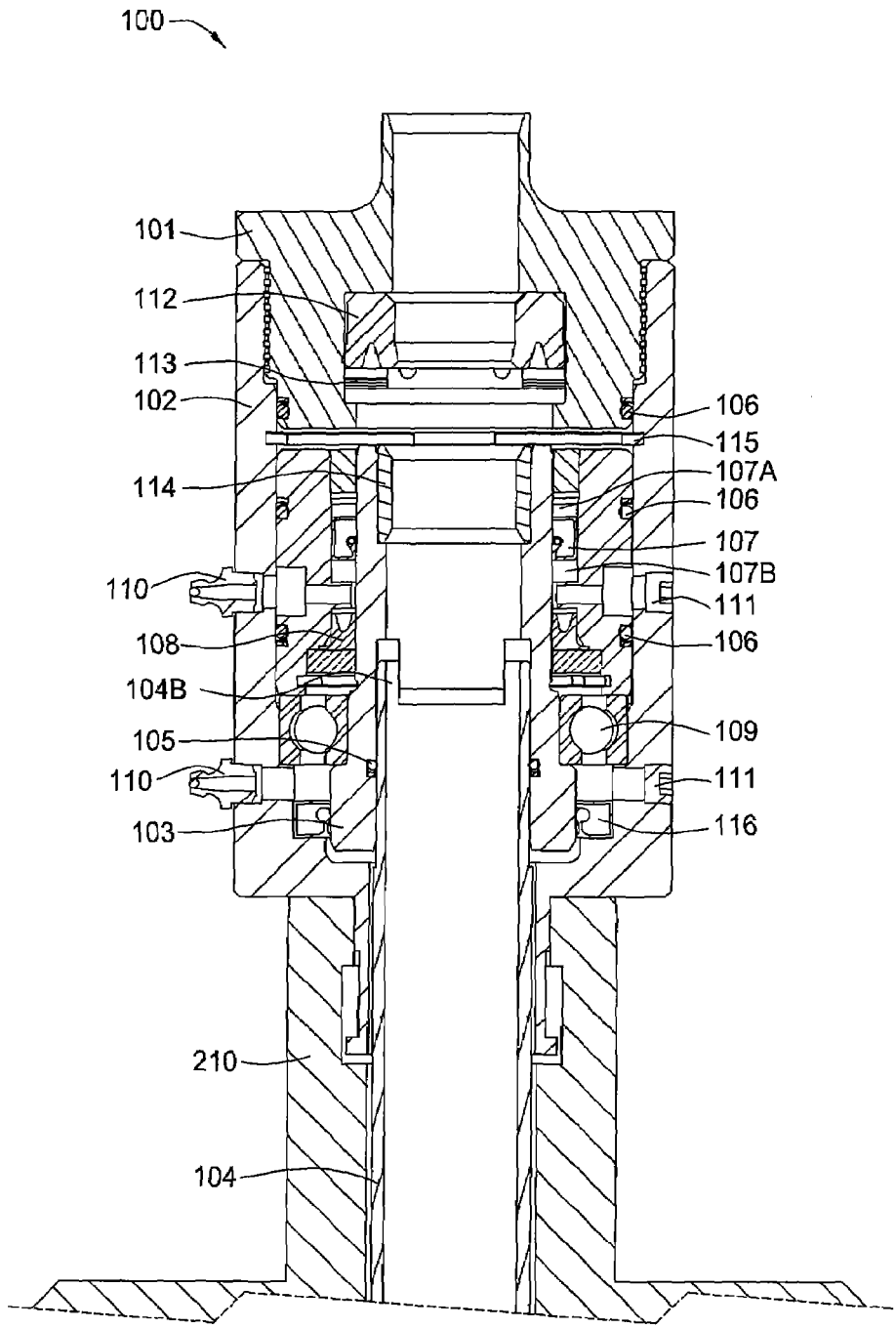
FIG. 3 is a detailed cross-sectional view of a rotating stuffing box and a portion of a corresponding drive unit according to one embodiment of the present invention.

FIG. 3 is a detailed cross-sectional view of a rotating stuffing box 100 and a portion of a corresponding drive unit 200 according to one embodiment of the present invention. A top sub 101 is installed at the top of the stuffing box 100 assembly and threadedly connects with a stuffing box housing 102 below. It should be noted that for some embodiments, other configurations of a top sub 101 could be utilized. For example, if it is desired to attach additional pieces of equipment above the stuffing box 100, the upper portion of top sub 101 may be configured with a threaded connection to allow for other tools to be threadedly connected above the top sub 101.

An upper standpipe 103 is located entirely within the stuffing box 100 and a corresponding lower standpipe 104 extends below from a bore in the stuffing box 100. The upper standpipe 103 and lower standpipe 104 comprise dogs 104B designed to prohibit rotational movement between the upper standpipe 103 and lower standpipe 104. In other words, the upper 103 and lower 104 standpipes do not rotate relative to each other. This interface between the upper and lower standpipes will be described further with reference to FIG. 6.

The arrangement of the upper standpipe 103, lower standpipe 104 and standpipe seal 105 should be noted. As described earlier, there is no rotational movement between the upper standpipe 103 and lower standpipe 104. In terms of axial movement between the upper standpipe 103 and lower standpipe 104, the dogs 104B ensure that there is very little relative movement (if any) during normal operation. Therefore, it is possible for the standpipe seal 105 to be a standard O-ring rather than a packing, which is typically used by existing tools. The standpipe seal 105, placed within the interface of the upper standpipe 103 and lower standpipe 104, prevents production fluid from leaking from escaping to the various annular gaps of the stuffing box 100 and the surrounding atmosphere.

As stated earlier, during operation, components of the drive string 40, such as the polished rod 41, are positioned in the bore of the stuffing box 100 and drive unit 200. Also, the downhole pump 60 is ensures that pressurized production fluid is being urged towards the surface through the annular space between the drive string 40 and the production tubing 50. At the surface, the production fluid continues to be urged upward through the annular surface between the drive string 40 and the inner bore of the lower standpipe 104 and upper standpipe 103.

The polished rod packing 112 prevents production fluid from escaping from the annular space between the polished rod 41 and the stuffing box 100. It should be noted that the annular spaces between the upper standpipe 103 and the stuffing box housing 102 are also pressurized by the production fluid.

In other words, the region above loaded lip seal assembly 107 is pressurized to the same pressure as the production fluid in the bore of the stuffing box assembly 100. As a result, the loaded lip seal assembly 107 is forced downwards towards a standpipe packing 108. In the process of moving downwards, the loaded lip seal assembly 107 pressurizes grease located immediately below in region 107B, to the production fluid pressure.

The result is that the standpipe packing 108 is under the same pressure as the production fluid. Those skilled in the art will acknowledge that a balanced seal implementation, such as the one described above, facilitates better performance of seals and packings such as the standpipe packing 108, which extends operating life of the stuffing box assembly 100. Particularly, a balanced seal configuration helps to prevent problems with packings such as "weep" associated with many rope type packings used in existing stuffing boxes.

A variety of sealing elements including the O-ring assemblies 106 and lower loaded lip seal assembly 116 are also utilized to prevent production fluid from escaping from annular areas within the stuffing box housing 102. The attributes and functionality of these additional sealing elements listed above are understood by those skilled in the art. They will also appreciate that many different varieties and configurations of sealing elements may be used in other embodiments of the present invention, as dictated by requirements of the specific application.

During operation, as the drive string 40 rotates, it may sway and whip, which will intermittently impart a transverse load against the stuffing box assembly 100, and more specifically to components such as the stuffing box housing 102. Accordingly, the stuffing box housing 102 will impart a corresponding transverse load against a standpipe bearing 109 that separates the stuffing box housing 102 and the upper standpipe 103. The standpipe bearing 109 is designed to accept the transverse loading and will facilitate smooth relative rotation between the stuffing box housing 102 (which is rotating with drive string 40) and the upper standpipe 103 while minimizing separation between the stuffing box housing 102 and the upper standpipe 103. A separation would result in leakage of the production fluid.

Grease zerks 110 are provided to allow for the injection of grease (and/or other lubricants) into the annular areas formed between the upper standpipe 103 and the stuffing box housing 102. Plugs 111 are utilized to retain the lubricants in the annular areas contained within the stuffing box assembly 100.

In addition, a polished rod packing 112 is provided. During operation, the polished rod 41 components of the drive string will be adjacent to this packing. A spacer 113 installed directly below ensures the packing will seal properly against the polished rod 41 during operation.

As described with reference to FIG. 1, the drive string 40 is lowered through the stuffing box 100 and the remainder of the drive system 10. A bushing 114 placed within the top portion of the upper standpipe 103 provides a guide for the drive string as it is lowered through the drive unit and as the drive string rotates in place (without axial movement) during pump operation. The bushing 114 prevents the drive string 40 from coming in contact with the upper or lower standpipes. Further, the bushing 114 assists in keeping the drive string 40 axially parallel with the stuffing box 100 assembly—this assists the rod packing 112 in preventing leakage of the production fluid.

It should be noted that the lower portion of the stuffing box housing 102 fits inside the top portion of the main shaft 210. A hexagonal profile is provided at the bottom of the stuffing box housing 102. A corresponding hexagonal opening is provided at the top of the main shaft 210. The interface between the stuffing box housing 102 and the main shaft 210 allows for quick and simple installation and removal of the stuffing box 100 from the drive system 10, and will be discussed in more detail with reference to FIG. 6.

Figure 4:
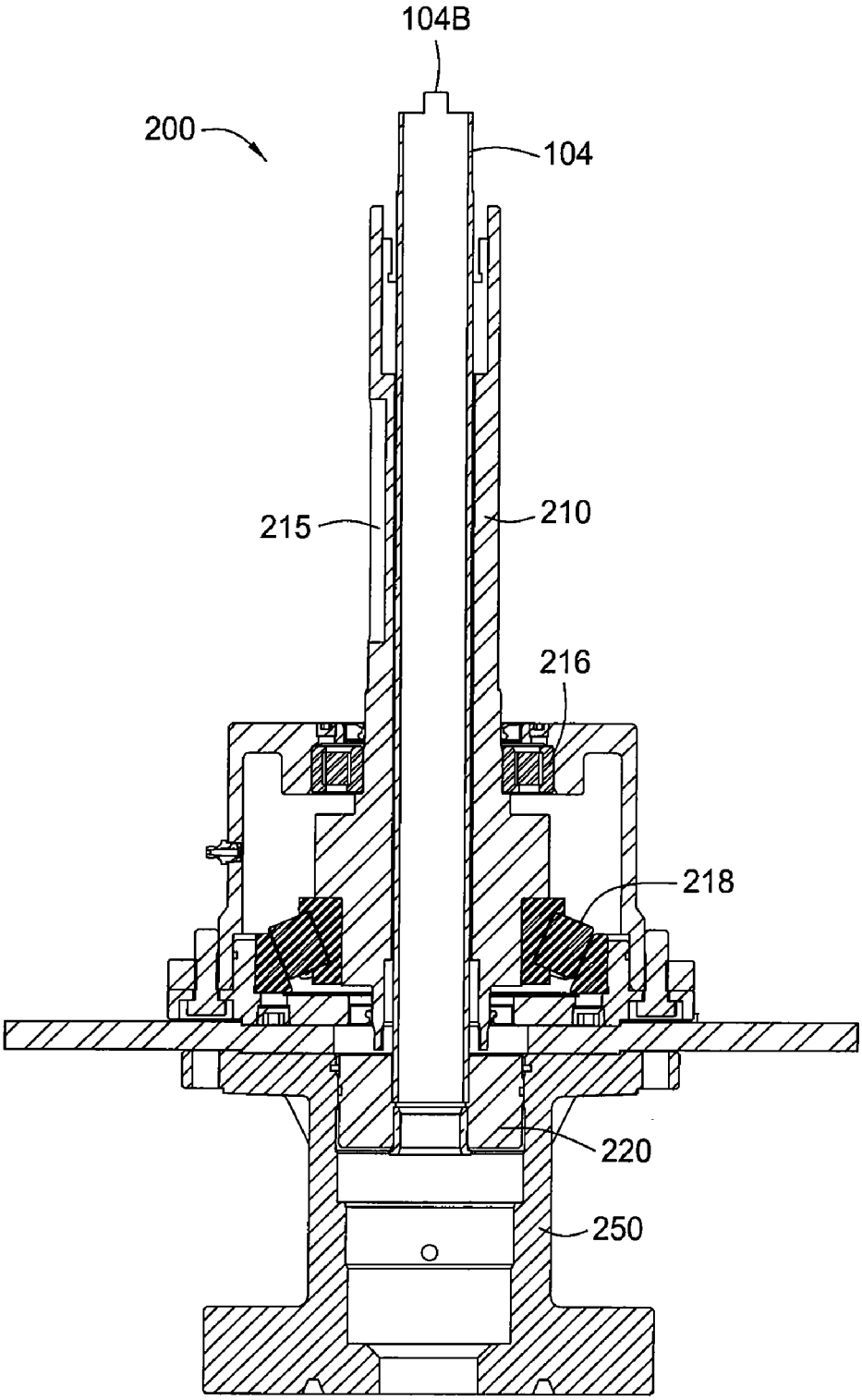
FIG. 4 is a detailed cross-sectional view of a drive unit according to one embodiment of the present invention.

FIG. 4 provides a detailed view of the drive unit 200. The entire lower standpipe 104 is shown. As can be seen, the lower standpipe 104 extends through the bore of the main shaft 210 and is anchored in the standpipe base 220. As mentioned earlier, the upper standpipe 103 and lower standpipe 104 do not rotate with the drive unit 200. The standpipe base 220 is secured within the top portion of the integral housing 250.

Figure 5:
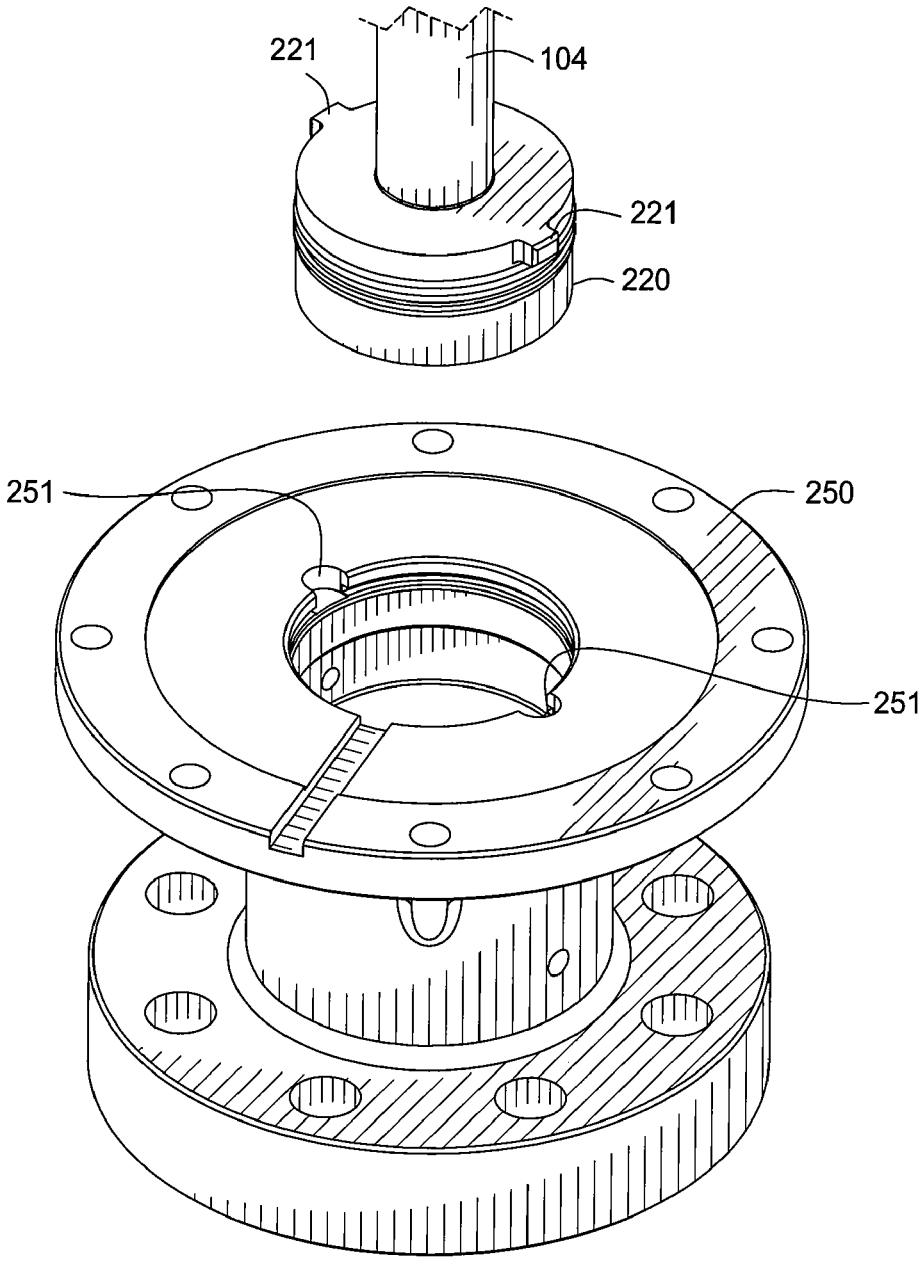
FIG. 5 illustrates the configuration of a lower standpipe, standpipe base and integral housing according to one embodiment of the present invention.

FIG. 5 provides a detailed view of the interface between the lower standpipe 104 and the standpipe base 220, and the interface between the standpipe base 220 and the integral housing 250. The lower standpipe 104 is press fit into the standpipe base 220—this ensures that the lower standpipe 104 does not rotate along with the main shaft 210. The standpipe base 220 is placed in the integral housing 250. The standpipe base comprises dogs 221 that fit into recesses 251, ensuring that the standpipe base 220 does not move relative to the integral housing 250.

Referring back to FIG. 4, it can be seen that the main shaft 210 is supported by upper bearings 216 and lower bearings 218. As is typical of other units known in the art, the drive unit 200 according to embodiments of the present invention is configured to support the weight of the entire drive string 40 and pump 60. During operation, upper bearings 216 are utilized to manage transverse loading, and lower bearings 218 are designed to counteract both transverse and axial loading. Essentially, upper bearings 216 and lower bearings 218 allow for smooth and uninterrupted rotation of the drive unit, drive string 40 and pump 60.

Figure 6:
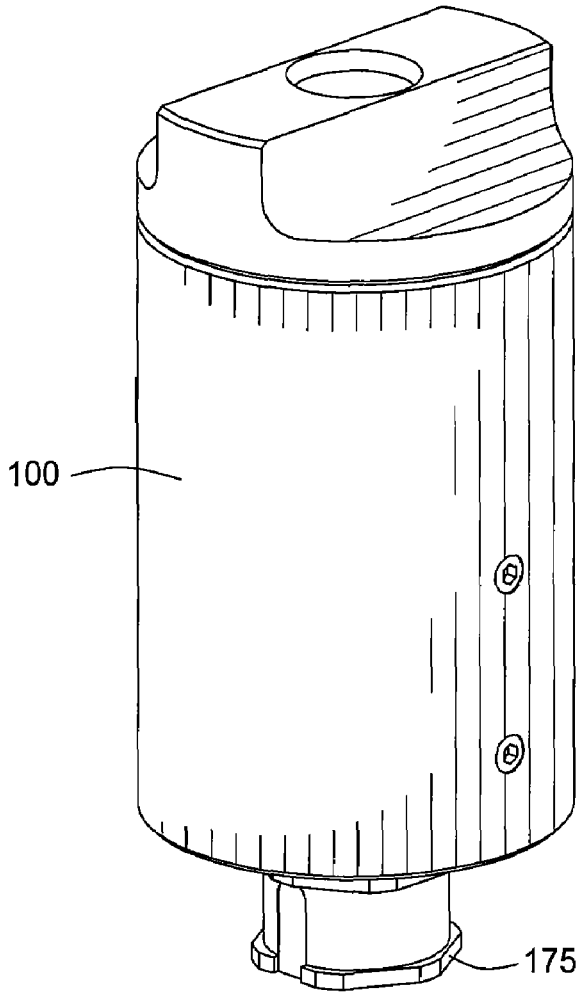
FIG. 6 illustrates an exterior view of a rotating stuffing box and drive unit according to one embodiment of the current invention.
Figure 6:
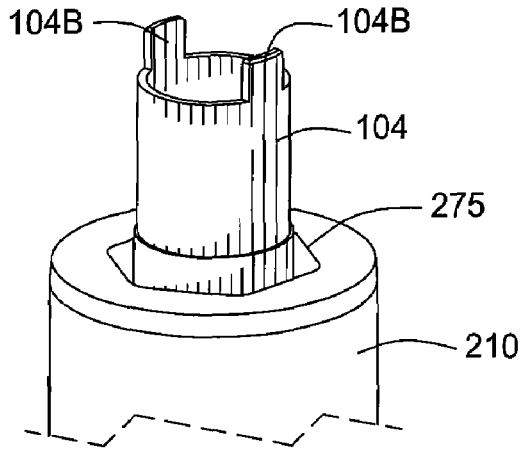

The stuffing box 100 is mounted on top of the main shaft 210. FIG. 6 illustrates an external view of the interface between the stuffing box 100 and the main shaft 210, and more specifically the corresponding hexagonal profiles, labeled with reference numbers 175 and 275, on the bottom of the stuffing box 100 and the top portion of the main shaft 210, respectively. The hexagonal profile on each of these components facilitates the quick removal of the stuffing box from the drive system 100.

For instance, the stuffing box assembly 100 can be removed by being turned approximately a quarter of a turn (in either direction) in a manner to allow for the hexagonal profile on the bottom of the stuffing box housing 102 to be matched with the hexagonal profile of the top portion of the main shaft 210. Once the profiles are matched up, the stuffing box 100 can be lifted axially upward relative to the main shaft 210 and removed. In other words, if the hexagonal profiles are not matched up, the stuffing box remains locked linearly onto the main shaft 210.

Accordingly, in order to install the stuffing box 100 onto the drive unit 200, the hexagonal profiles first need to be matched. Next, the stuffing box should be lowered onto the main shaft 210 of the drive unit 200. Finally, the stuffing box 100 needs to be turned a quarter turn in either direction in order to be locked into place.

To demonstrate the advantages offered by embodiments of the present invention in the context of PCP implementations, procedures for replacing a conventional bottom mounted stuffing box and a top mounted stuffing box according to one embodiment of the present invention are described and compared below.

As stated earlier, bottom mounted stuffing boxes are typically installed between the drive unit and wellhead. In order to replace a bottom mounted stuffing box, the first step is to shutdown the well by following safe shutdown procedures. Next, the weight of the drive string is taken off the drive unit and is supported by a flushby truck or separate winch. Next, the entire drive system (including the hydraulic motor and drive unit) is disconnected from the wellhead; the drive unit is lifted out of the way with yet another winch line or picker. Next, the drive string is secured by setting a safety clamp (such as that described in commonly owned U.S. Pat. No. 6,557,643) on the polished rod that is exposed between the suspended drive system and wellhead. At this point, the safety clamp can be relied upon to maintain the weight of the drive string 40. Next, with the secondary winch line or picker truck, the entire drive system 10 can be lifted up and over the drive string 40. Finally, the bottom mount stuffing box is accessible and it is possible to remove the bottom mount stuffing box and replace it with another stuffing box. In order to resume operations, all the steps listed above would have to be performed in reverse to reinstall the drive system onto wellhead.

In contrast, a top mounted stuffing box, according to embodiments of the present invention, can be replaced easily without disconnecting the drive system from the wellhead. First, the well is shutdown according to the proper procedures. Next, a safety clamp 230 can be used to support the weight of the drive string below the stuffing box 100. Finally, the stuffing box is turned approximately a quarter turn in either direction, lifted upwards and removed from the drive system 10.

Accordingly, the stuffing box is installed by matching the hexagonal profiles on the bottom of the stuffing box 100 and the top of the drive unit 200. Next, the stuffing box 100 is lowered until corresponding tabs 104B of the upper standpipe 103 and lower standpipe 104 make contact. Finally, the stuffing box 100 is turned a quarter turn in either direction to ensure that the stuffing box is locked onto the drive system.

A top mounted rotating stuffing box implemented according to embodiments of the present invention provides a variety of benefits including quick and easy installation or replacement, better sealing performance and longer operating life. The split standpipe configuration described herein facilitates ease of installation, while a balanced seal configuration improves sealing performance and extends operating life. Further, the balanced seal configuration allows for avoiding problems (such as weep) and the relatively short operating life associated with conventional rope packings. In addition, the top mounted stuffing box of the present invention is configured to interface with a drive unit (belonging to a drive system) in a manner that does not damage the drive unit as do many existing stuffing boxes. Accordingly, the top mounted rotating stuffing box described above with reference to embodiments of the present invention provides numerous advantages over existing stuffing boxes available in the marketplace.

While the foregoing is directed to embodiments of the present invention, other and further embodiments of the invention may be devised without departing from the basic scope thereof, and the scope thereof is determined by the claims that follow.

The invention claimed is:

1. A down hole pump implementation comprising:

a drive string;

a drive system comprising a top mounted rotating stuffing box, an upper standpipe and a lower standpipe, wherein the top mounted rotating stuffing box rotates with the drive string and wherein the interface between the standpipes is such that the lower standpipe engages the upper standpipe below at least a portion of a standpipe packing within the top mounted rotating stuffing box; and a downhole progressing cavity pump.

2. The downhole pump implementation of claim 1, wherein the drive system includes a hydraulic motor used to impart torque and rotate the drive string.

3. The downhole pump implementation of claim 1, wherein the upper standpipe and lower standpipe interface via dogs.

4. The downhole pump implementation of claim 3, wherein an O-ring seal is utilized to provide a seal between the upper standpipe and lower stand pipe.

5. The downhole pump implementation of claim 1, wherein the drive system comprises a drive unit, wherein the top of the drive unit includes a bore with an hexagonal profile; and the bottom of the stuffing box configured with a hexagonal profile which corresponds to the hexagonal profile of the drive unit.

6. The downhole pump implementation of claim 1, wherein the upper standpipe and the lower standpipe are rotationally fixed to each other.

7. A method of removing a stuffing box comprising:

providing a drive system, wherein the drive system comprises a top mounted rotating stuffing box and a drive unit;

providing a safety clamp for securing the weight of a drive string;

shutting down the well;

securing the weight of the drive string by placing the safety clamp on an exposed portion of the drive string at the surface;

holding the drive unit stationary;

rotating the stuffing box, relative to the drive unit; and lifting the stuffing box upwards and removing the stuffing box from the drive system.

8. The method of claim 7, wherein the stuffing box is rotated a quarter turn in either direction.

9. An assembly for pumping fluid comprising:

a drive system comprising a drive unit;

a top mounted rotating stuffing box positioned adjacent the drive unit;

an upper standpipe interfacing with a lower standpipe, wherein the upper standpipe is entirely located within the top mounted rotating stuffing box; and a drive string having a pump member operatively attached thereto.

10. The assembly of claim 9, wherein a radial bearing accommodates relative rotation between the top mounted rotating stuffing box and the upper standpipe.

11. The assembly of claim 9, wherein the lower standpipe is placed within the bore of the drive unit and extends for the length of the drive unit.

12. The assembly of claim 9, wherein drive system rotates the drive unit, drive string and the top mounted rotating stuffing box at an angular velocity within a given range.

13. The assembly of claim 9, wherein the upper standpipe and lower standpipe remain stationary while the top mounted rotating stuffing box, drive system and drive unit are rotating.

14. The assembly of claim 9, wherein the top mounted rotating stuffing box comprises a stuffing box housing configured with a hexagonal profile which corresponds to a hexagonal bore at the top portion of the drive unit.

15. The assembly of claim 9, wherein a standpipe packing within the top mounted rotating stuffing box engages a portion of the upper standpipe.

16. The downhole pump implementation of claim 9, wherein the upper standpipe and the lower standpipe are rotationally connected.

17. An assembly for pumping fluid comprising:

a drive system comprising a drive unit;

a top mounted rotating stuffing box positioned adjacent the drive unit;

an upper standpipe interfacing with a lower standpipe, wherein the upper standpipe and lower standpipe interface with each other via dogs;

a drive string; and a pump operatively attached to the drive string.

18. A downhole pump implementation comprising:

a drive string;

a drive system comprising a top mounted rotating stuffing box, wherein the top mounted rotating stuffing box comprises a balanced seal implementation and wherein the drive system further comprises an upper standpipe and a lower standpipe that interface via dogs; and a downhole progressing cavity pump.

19. The downhole pump implementation of claim 18, wherein the balanced seal implementation comprises a loaded lip seal assembly and a standpipe packing, wherein the loaded lip seal assembly pressurizes the region surrounding the standpipe packing.

20. The downhole pump implementation of claim 18, wherein the drive system includes a hydraulic motor used to impart torque and rotate the drive string.

21. The downhole pump implementation of claim 18, wherein the drive system comprises:

a drive unit, wherein the top of the drive unit includes a bore with an hexagonal profile; and the bottom of the stuffing box configured with a hexagonal profile which corresponds to the hexagonal profile of the drive unit.

* * * * *